US005486989A

United States Patent [19]

Compton

[11] Patent Number: 5,486,989

[45] Date of Patent: Jan. 23, 1996

[54] LUMINAIRE WITH MODULAR LOUVER SHIELDS

[75] Inventor: Wayne W. Compton, Chino Hills, Calif.

[73] Assignee: Kim Lighting, Inc., City of Industry, Calif.

[21] Appl. No.: 150,958

[22] Filed: Nov. 12, 1993

[51] Int. Cl.[6] ..... F21V 13/00

[52] U.S. Cl. ..... 362/291; 362/147; 362/354

[58] Field of Search ..... 362/147, 290, 362/311, 361, 363, 340, 325, 342, 291, 354, 257

[56] References Cited

U.S. PATENT DOCUMENTS

| | | | |
|---|---|---|---|
| 1,900,436 | 3/1933 | Dourgnon | 362/290 |
| 2,437,522 | 3/1948 | Handler | 362/354 |
| 3,697,740 | 10/1972 | Breed et al. | 362/257 |
| 5,034,869 | 7/1991 | Choi | 362/147 |

FOREIGN PATENT DOCUMENTS

| | | | |
|---|---|---|---|
| 9879 | of 1909 | United Kingdom | 362/340 |

*Primary Examiner*—Ira S. Lazarus
*Assistant Examiner*—Sara Sachie Raab
*Attorney, Agent, or Firm*—Lyon & Lyon

[57] ABSTRACT

A luminaire with modular louver shields is disclosed that is particularly suited for use in the interior of parking garage structures. The luminaire is constructed so as to address the three-dimensional lighting requirements in parking garages, providing adequate illumination while reducing the glare in drivers and pedestrians eyes and reducing the amount of light that spills out of the structure. This is accomplished by using a lens that disperses light in the appropriate manner and removable louver assemblies that block or diffuse light rays that would otherwise shine in drivers and pedestrians eyes or spill out into the adjacent neighborhood. The lens and modular louver assemblies can be utilized in a number of configurations depending on the layout of the structure and the objective being addressed (eg: glare control, light spill). Once the luminaires are installed, the louvers can be rearranged to accommodate changing lighting requirements.

28 Claims, 10 Drawing Sheets

LUMINAIRE WITH MODULAR LOUVER SHIELDS

FIELD OF THE INVENTION

This invention relates to luminaires and, particularly, to a luminaire which is especially suited for the interior illumination of parking structures.

BACKGROUND OF THE INVENTION

As the cost of urban land increases, the use of multi-storied parking structures increases over traditional parking lots located at grade level. Parking structures generally serve office buildings, shopping centers, travel departure points and high-density dwellings.

The nature of parking structures has evolved from utilitarian "garage-like" structures to well-lit, inviting spaces that are architecturally compatible with the buildings they serve. In addition to utilizing land more efficiently, parking structures put people closer to their destinations and provide covered access when the driver becomes a pedestrian.

Typically, the interior of parking structures includes one or more driveways that serve as the means for circulating traffic within the structure. Traffic flow can be either one-way or two-way. Parking stalls are generally located on either side of the driveway and are oriented diagonally or at right angles to the driveway.

Because of the close proximity of pedestrians to vehicles, glare from the lighting is of a greater concern than on a city street. For exterior parking lots and streets, the lighting requirements are two-dimensional in nature, and the focus is on grade level lighting. In the interior of a parking structure, the lighting requirements must be considered in three dimensions. Lighting must be provided to floors, walls, ceilings, columns and directional graphics (signage) on columns and beams. Also, vehicles need to be illuminated to a height of 30 to 42 inches above the floor.

These various requirements mandate that a luminaire be capable of casting illumination to the far extent of the parking area, down the length of the driveway, at a level 30 to 42 inches above the floor, and to locations 6 feet high on columns and walls. A luminaire with this ability will be very bright because it must project light at very high angles. Yet, it must control light so that it does not blind drivers while they negotiate tight spaces and avoid pedestrians. The luminaire must also control the amount of light spill from the garage, especially in and around sensitive residential areas.

A conflict arises from the requirement that light be cast up to 6 feet above the floor because this same light would inadvertently be cast into the eyes of drivers operating within the space. The solution to this potentially dangerous paradox is to shield offending light rays from the direction of oncoming traffic while not reducing the necessary light to other areas of the space.

Another problem with luminaires that have "volumetric" distribution patterns is that the light from these units can be very bright when viewed from the exterior of the structure. This light spill is more serious in parking structures than in other buildings because the exterior walls are generally left open. The exterior walls need to be left open to promote good ventilation because of the dangerous gasses emitted by the operation of motor vehicles. This light spill not only detracts from the night time appearance of the building, but can be in violation of "light trespass" ordinances that are becoming more prevalent across the country. The solution for this problem is the same as for protecting the visibility of drivers within the structure—a shield on luminaires located near the outside walls.

SUMMARY OF THE INVENTION

A luminaire device of the present invention is designed to address the three-dimensional lighting requirements of parking garages and solve the problems of glare control and spill light control. This is accomplished by altering the direction of light emanating from the luminaire. Basically, four components determine the amount and direction of light emitted. These are a light source (eg: light bulb), reflector, refracting lens, and louvers.

According to an exemplary embodiment of this invention, a light source hangs below a reflector, which reflects light at predetermined angles based on the curvature of the reflector. A refracting lens, also known as a globe, changes the direction of the light as it passes through the lens. The change in direction is based on the shape and orientation of the lens. Light passes through the lens either directly from the light source or after reflecting off of the reflector.

Louvers disposed as horizontal bands are placed on the outside of the lens and control the vertical flow of light, so that the luminaire does not create glare in drivers or pedestrians eyes. The louvers are positioned so as to allow light to travel at angles below where a driver's or pedestrian's eyes are expected to be, and to control the amount of spill light. In the preferred embodiment, multiple louvers of a circular shape are used which match the shape of the exterior of the refracting lens.

Accordingly, it is an object of the present invention to provide an improved luminaire which emits sufficient light to cover the three-dimensional shape of a parking garage.

Another object of the present invention is to control the glare in drivers eyes.

Another object of the present invention is to control the glare in pedestrians eyes.

Another object of the present invention is to control the amount of light spill from the exterior of the parking garage.

BRIEF DESCRIPTION OF THE DRAWINGS

These and other objects of the present invention will become better understood through a consideration of the following description taken in conjunction with the drawings in which.

DETAILED DESCRIPTION

Physical description

Figure 1A:
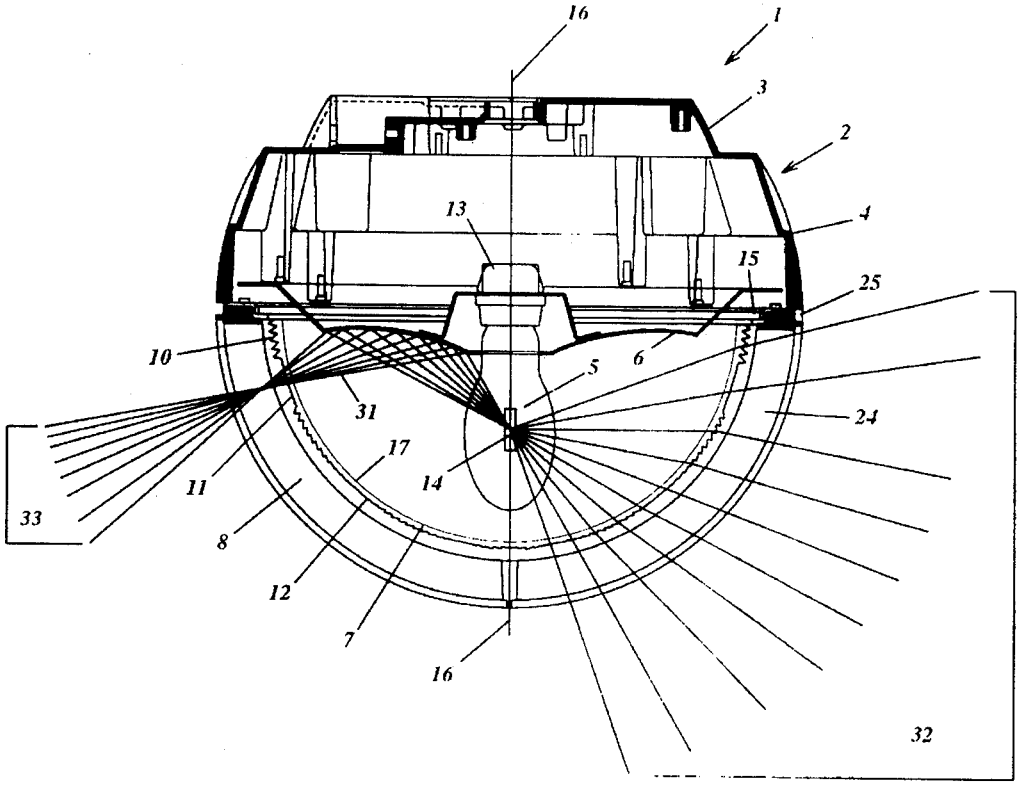
FIG. 1*a* is a cross-sectional view and ray trace diagram illustrating the luminaire and the vertical light distribution. The ray traces depict both reflected and refracted light.

Turning now to the drawings, FIGS. 1–10 depict a luminaire 1 of the type disclosed herein. Referring particularly to FIG. 1, the luminaire 1 comprises the following major components. An electrical housing 2 which is preferably of one-piece construction and which includes a mounting cap 3 and a housing body 4. The housing 2 contains all of the mechanical and electrical connections, including an electrical socket 13 for screwing in a light bulb 5. For the preferred embodiment, the mounting cap 3 and body 4 are circular in shape, when viewed from the top or the bottom. The mounting cap 3 is used to mount the luminaire 1 directly to a ceiling outlet or to an outlet that is suspended from the ceiling.

A reflector 6 is mounted to the housing 2 using conventional means known in the art (eg: welded, screwed on, etc.). As viewed from below, the reflector 6 is substantially circular in shape and contains a hole in the middle for mounting the socket 13 and light bulb 5. The reflector 6 is mounted above the light bulb arc tube 14 so that light rays are reflected in a generally downward direction, as shown by rays 31 in FIG. 1.

Figure 11:
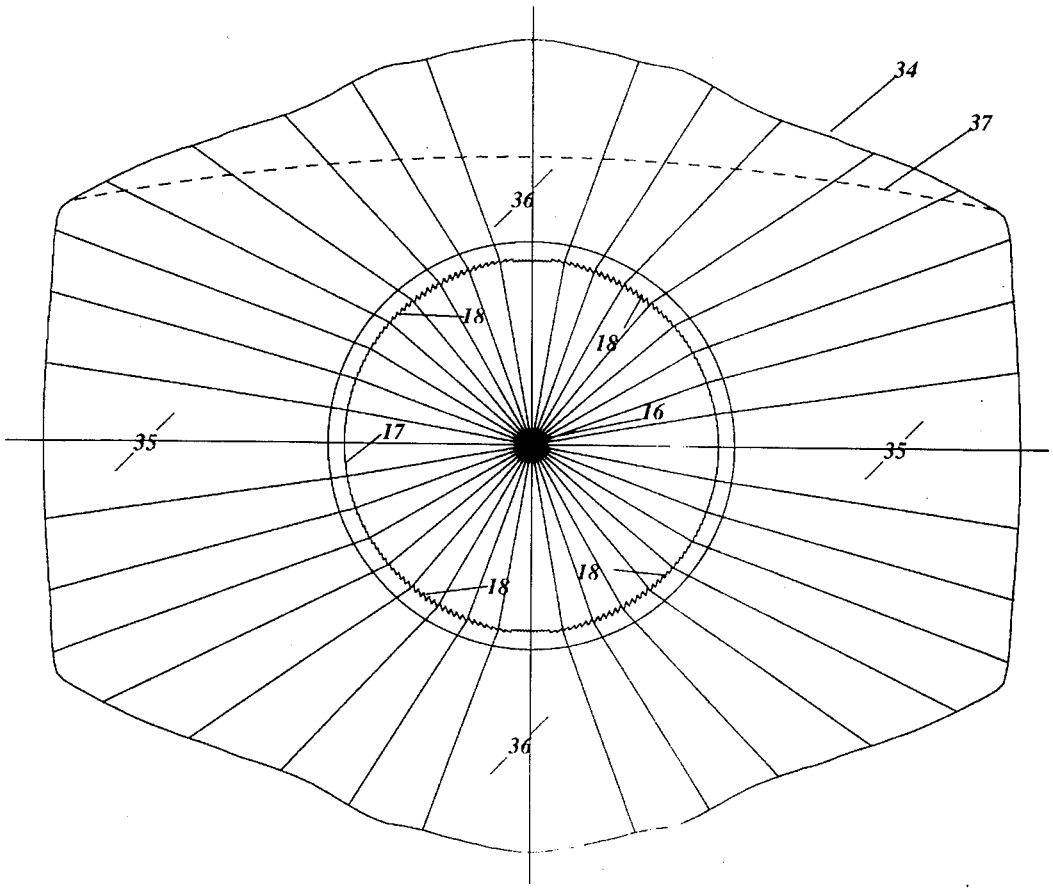
FIG. 11 is a ray trace diagram illustrating the horizontal light distribution. The full pattern illustrates the distribution without a louver. The dotted line illustrates the extent of the light distribution where a single louver assembly is used.

A lens 7 is generally constructed of glass or plastic and is frictionally mounted to the housing 2 using a lens frame 8. The lens frame 8 also preferably serves as a louver mount as will be discussed below. The lens 7 has a circular flange 15 on its outer perimeter that is positioned between the housing body 4 and the lens frame 8. The lens frame 8 comprises a set of four ribs 24 and a disc 25. The inner diameter of the disc 25 is sized to fit around the lens 7 and receive the flange 15, thus holding the lens 7 in place on the housing body. The lens 7 is generally in the shape of a half globe. The outer surface of the lens 7 has alternating jagged 10 & 12 and smooth 11 surfaces that refract light in different directions. The ridges that form the jagged surfaces 10 & 12 and smooth surface 11 extend radially around an axis 16 along the perimeter of the lens 7, so that any cross-section about the axis 16 is substantially identical. As shown in FIG. 11, the inner surface 17 of the lens 7 has ribs 18 around the inner surface that extend upwardly and substantially vertically from the bottom of the lens away from the center axis 16 to the flange 15. FIG. 11 is a cross-sectional, horizontal view of the lens at a point between the axis 16 and the flange 15 (flange 15 not shown in FIG. 11).

Figure 1B:
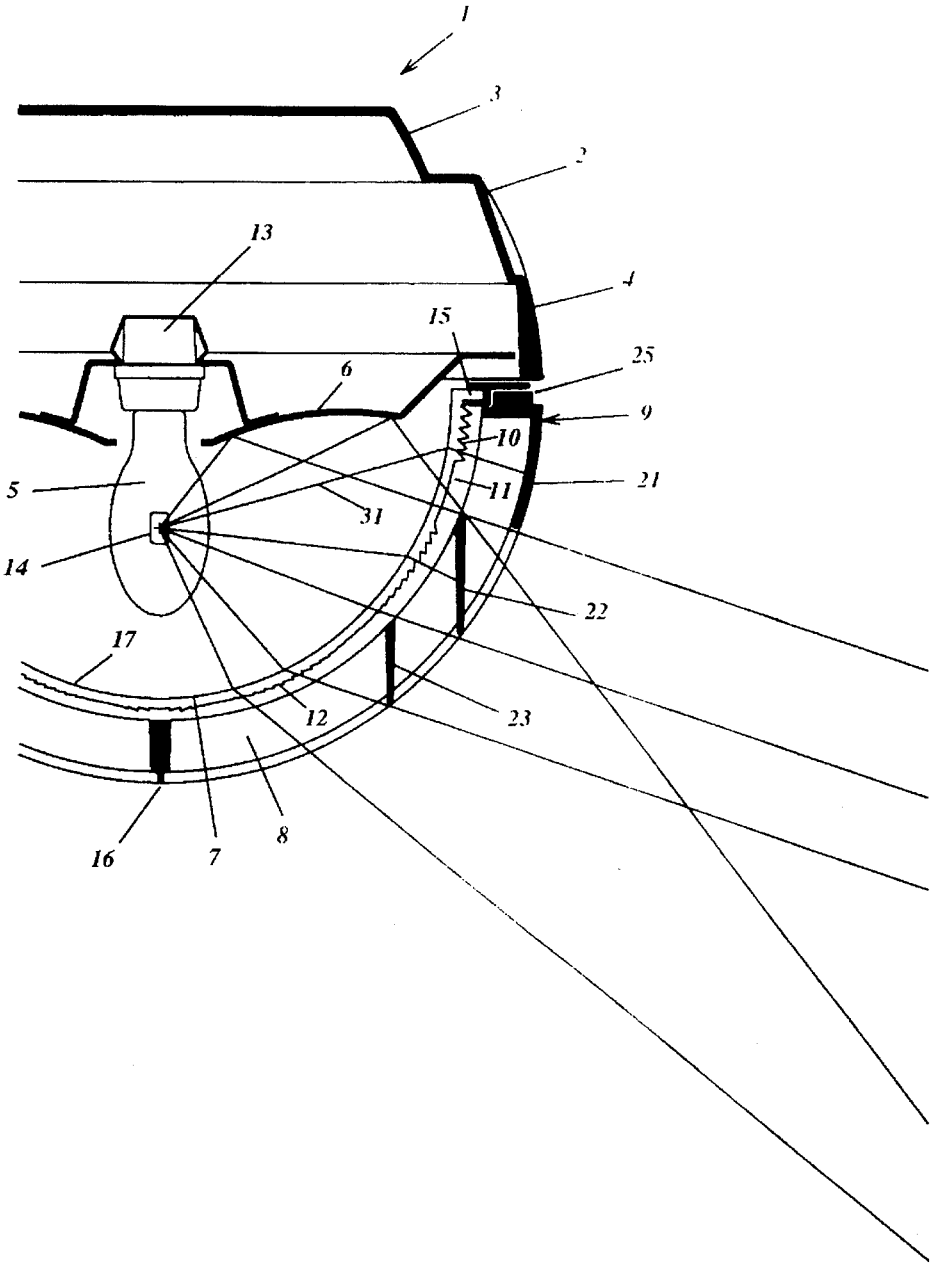
FIG. 1*b* is a cross-sectional view of the luminaire showing louvers thereof and the effect thereof on the light patterns.
Figure 2:
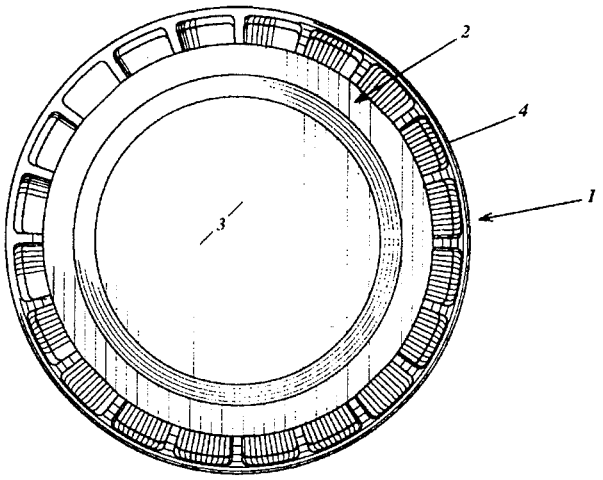
FIG. 2 is a top view of a luminaire, showing a housing body and a mounting cap that normally attaches to a garage ceiling.
Figure 3:
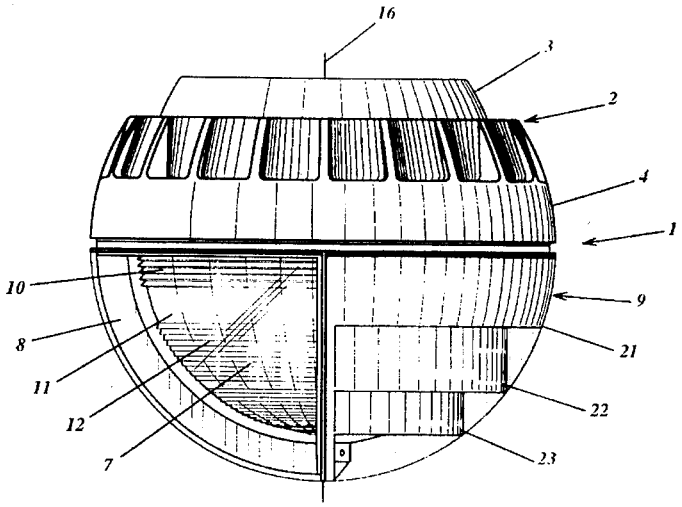
FIG. 3 is a side view of the luminaire, showing two of four quadrants, one of which contains a louver assembly.
Figure 4:
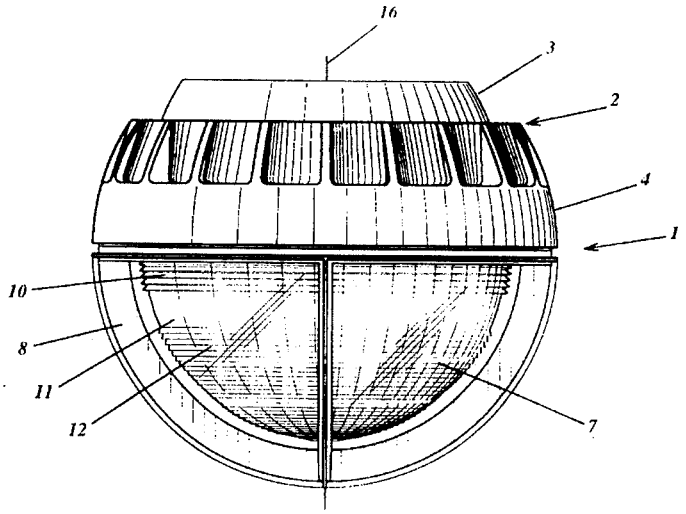
FIG. 4 is a side view of the luminaire, showing two of four quadrants, neither of which includes a louver assembly.
Figure 5:
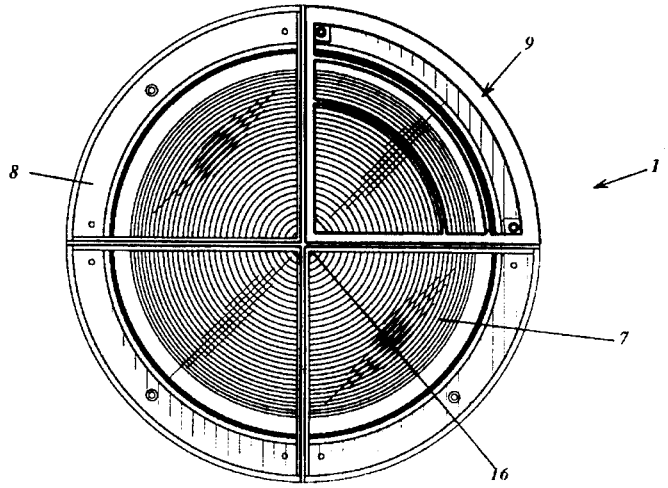
FIG. 5 is a bottom view of the luminaire, showing a lens, lens frame, and one louver assembly.
Figure 6:
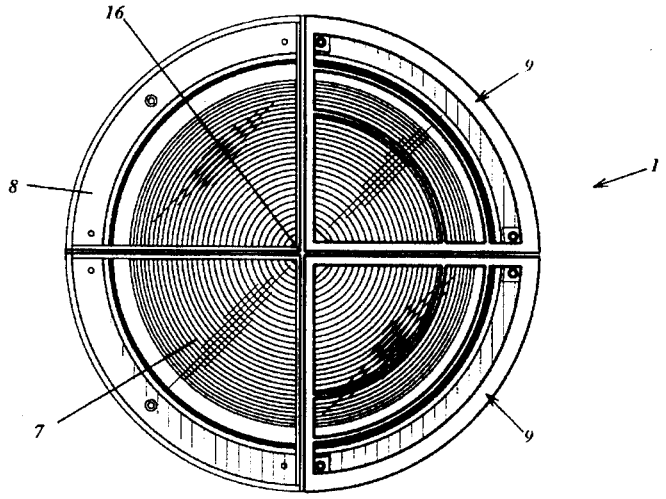
FIG. 6 is a bottom view of the luminaire, showing the lens, lens frame, and two louver assemblies placed in adjacent quadrants.
Figure 7:
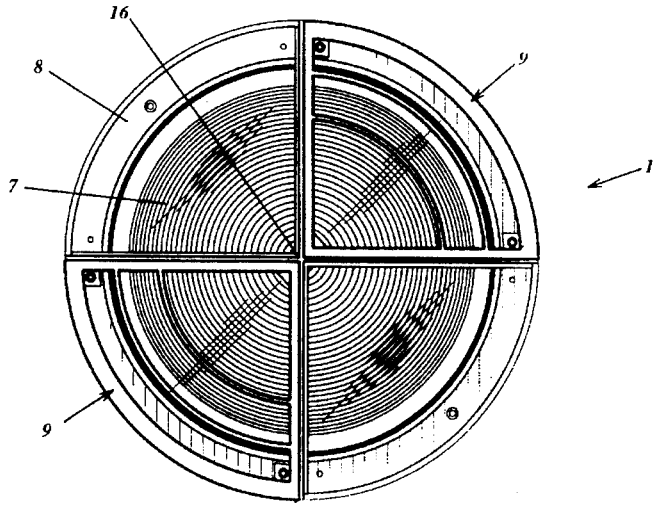
FIG. 7 is a bottom view of the luminaire, showing the lens, lens frame, and two louver assemblies placed in opposite quadrants.
Figure 8:
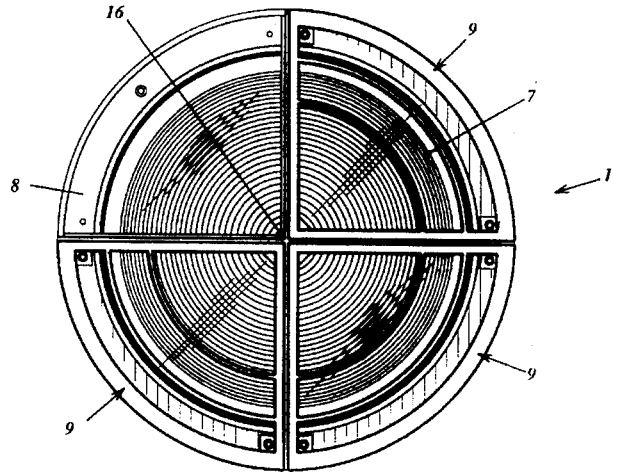
FIG. 8 is a bottom view of the luminaire, showing the lens, lens frame, and three louver assemblies.
Figure 9:
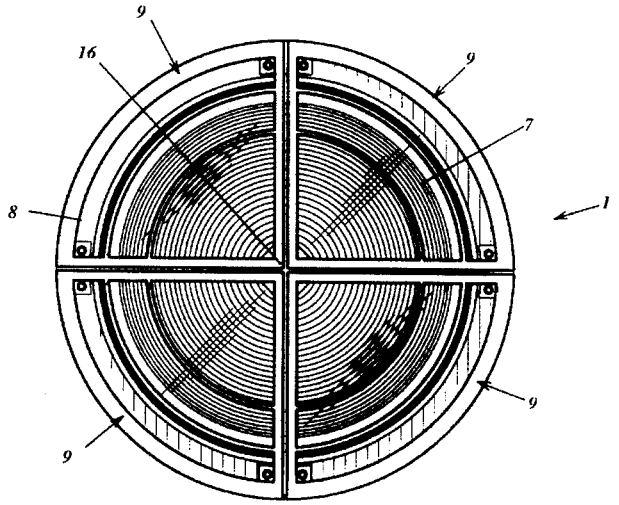
FIG. 9 is a bottom view of the luminaire, showing the lens, lens frame, and four louver assemblies.
Figure 10:
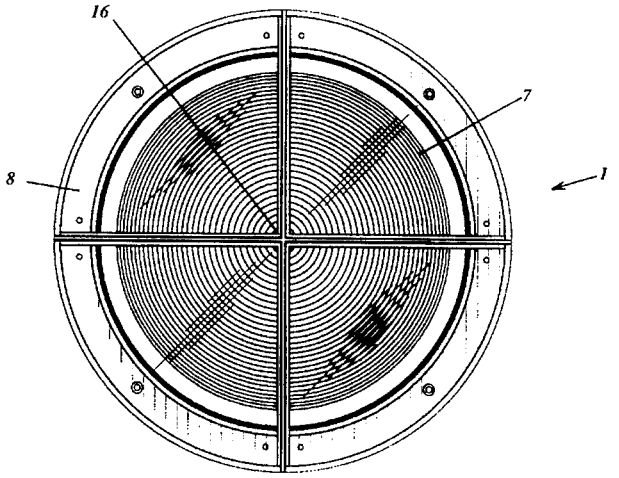
FIG. 10 is a bottom view of the luminaire, showing the lens, lens frame, and no louver assemblies.

In the preferred embodiment, there are four quadrants created by the ribs 24 of the lens frame 8. A louver assembly 9 (see FIGS. 1*b* & 3) can be mounted in each of the quadrants to control the vertical flow of light. Each louver assembly 9 can have multiple louvers, depending on the amount of light that is desired. In the preferred embodiment, each louver assembly 9 preferably has three integral louvers 21–23 (as depicted in FIGS. 1*b* & 3). The louvers are circular shaped and partially encircle the center axis 16 (see FIG. 1) and extend substantially vertically toward the floor. Each louver generally extends below the horizontal plane of the top of the adjacent louver that is located nearer to the center axis 16 (see, for example, FIG. 3 where the bottom of louver 21 partially obscures the top of louver 22).

Each quadrant is independent of all others, so a louver assembly 9 may be used in any combination of the quadrants (see FIGS. 3–10 for illustrations of various combinations). The preferred embodiment uses removable louver assemblies that can be positioned on the outside of any one or more, or all, quadrants of the lens frame 8.

As disclosed above, the preferred embodiment comprises a lens 7 that is substantially in the shape of a half globe, with louvers mounted on the outside of the lens 7 on a lens frame 8. However, the lens 7 and the louvers 9 could be altered and still remain within the scope of this invention. The lens 7 could be of cylindrical, frustoconical, or rectangular shape, to name a few shapes. The lens 7 could be constructed of different materials. Furthermore, both the location and the method of attachment of the louvers 9 could be varied. For example, the louvers 9 could be attached directly to the housing 2, the lens 7, or the ceiling. Also, the louvers 9 could be attached to the inside or outside of the lens.

Operation without the louvers

When the louvers are not present, the light rays emitted from the luminaire are as shown in FIGS. 1 & 11. FIG. 1 depicts the vertical reflection and refraction of light. Light from the light bulb 5 is emitted in one of two ways. First, the light waves proceed directly from the bulb 5 to the lens 7, where they are refracted at an angle based on the incident angle, the shape of the interior and exterior surface of the lens, and the material of which the lens 7 is made. The outer surface of the lens is constructed so as to refract light primarily upward toward the ceiling and downward toward the floor, as shown on the right side of FIG. 1. The jagged surface 10 & 12 area of the lens 7 causes the emitted light to be spread (see generally the area indicated at 32) rather than focused (see generally the area indicated at 33). The shape of the jagged surface 10 & 12 generally determines the angle of refraction.

Second, the light is reflected off the reflector 6 and then through the lens 7. As shown in FIG. 1, the reflector is shaped so as to direct the light rays generally downward, as at 31. In the preferred embodiment, the reflected light passes through the smooth area 11 of the lens 7.

FIG. 11 illustrates the horizontal distribution of light for both reflected and refracted light. The outer boundary 34 illustrates the distribution without any louvers. The shape of the pattern is determined by the type of lens used, and is due to refraction of the light rays. Preferably, the ribs on the inner surface 17 are of differing shape around the lens 7, which causes light to be refracted to form the oblong shape as illustrated by 34. Light is refracted toward those areas where the pattern is the broadest 35, and away from those areas where the pattern is the narrowest. A different pattern could be obtained using a different lens shape and a different lens surface.

Operation with the louvers

The light patterns described above lead to a tradeoff between breadth of coverage versus glare. The wider the coverage, the more glare in drivers eyes and the more light that spills into the neighborhood. This tradeoff can be partly addressed using louvers 9 to selectively block or diffuse light emanating from the luminaire 1. The preferred embodiment uses removable louver assemblies 9 that can be positioned on the outside of any one or more, or all, quadrants of a lens frame 8. The louver assemblies 9 each have three louvers, to allow the proper amount of light to be reflected and refracted vertically out of the luminaire 1. The luminaire 1 can be constructed to use a different number of louver assemblies, and they can be removable or permanently attached. Also, the number of louvers per louver assembly can be varied.

FIGS. 1*b* & 3 depict a luminaire 1 with one louver assembly in place. The louvers are circular shaped and partially encircle the center axis 16, (see FIG. 1) and extend substantially vertically toward the floor. A first louver 21 is located furthest from the axis 16 and extends down past the top of a second louver 22, which extends down past the top of a third louver 23. This configuration blocks direct light from the lens to the horizontal plane, or to an angle below horizontal, where the light would otherwise shine directly into drivers or pedestrians eyes. The louvers do not cut off all of the light. Rather, the light is reflected off the inner and outer surfaces of the louvers until it exits the luminaire. The resultant light is a "softer" light that solves the problems of glare and spill light.

As mentioned above, FIG. 11 shows the horizontal distribution of light. The outer pattern depicts the use of a luminaire with no louvers. The dotted line 37 on the upper half of FIG. 11 illustrates the shape of the light pattern when one louver is used. The dotted line 37 appears on the same side of the luminaire where a louver assembly 9 is located.

The effect of the louvers is three-fold. First, they cut down on the glare in the driver's eyes, or alternatively cut down on the spill light. Second, they make the light "softer" because the multiple reflections off of the louvers diffuse the light, and third, they cut down the size of the light pattern.

Placement of the luminaires

Individual luminaires can be placed in various configurations, depending on the layout of the parking garage and the objectives sought to be achieved through the use of louvered luminaires. In general, the luminaires will have a light pattern similar to that depicted in FIG. 11. Therefore, they need to be spaced so as to maximize the coverage and yet minimize the glare.

Figure 12:
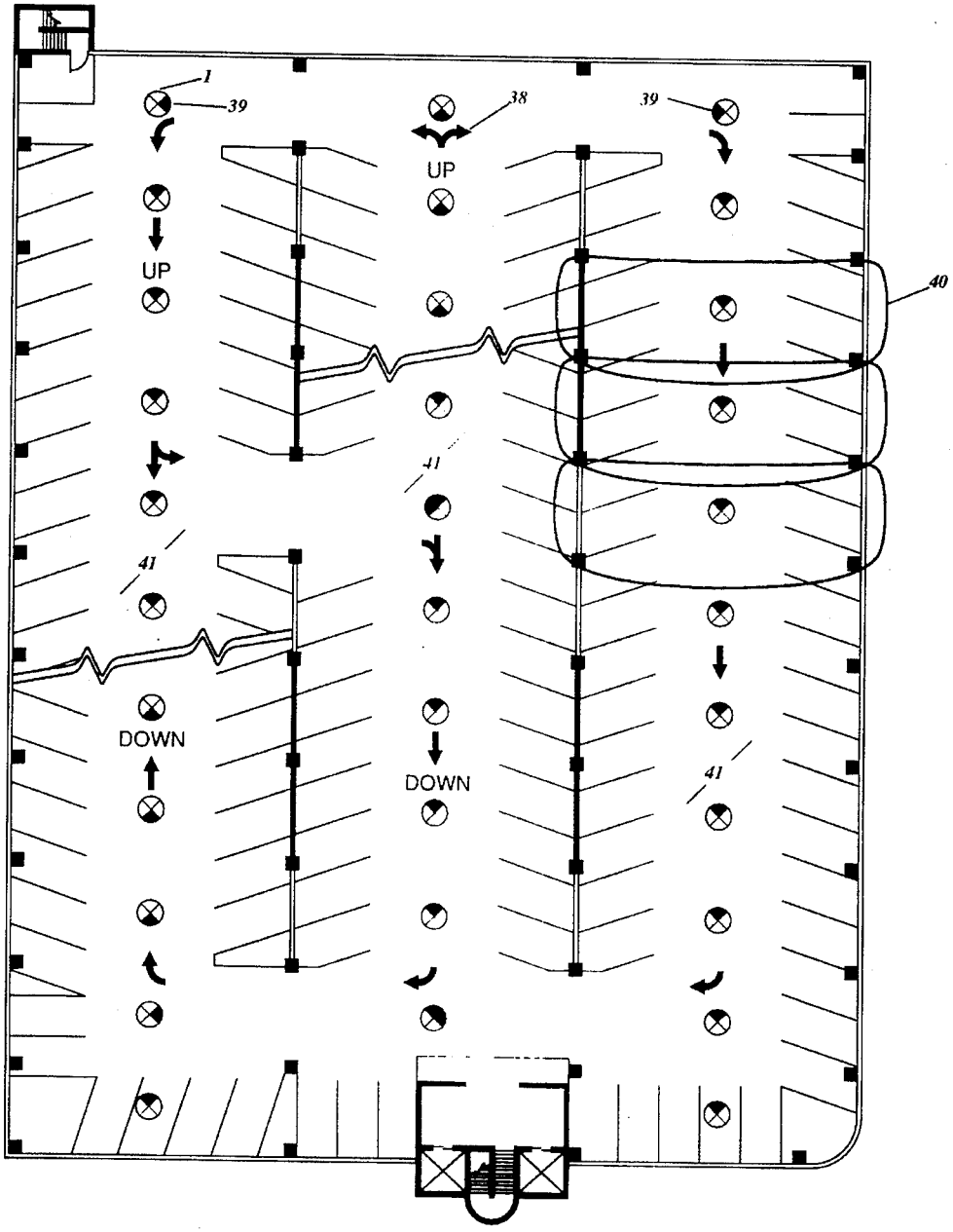
FIG. 12 is a plan view of a single floor of a typical scissored-ramp parking garage, illustrating the placement of a single row of luminaires where there is one-way traffic flow.
Figure 12A:
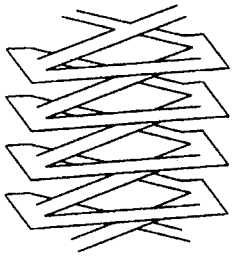
FIG. 12*a* depicts the relative ramp orientation of a typical scissored-ramp parking garage (with exaggerated ramp angles).

FIG. 12 shows a typical scissored-ramp parking garage with one-way traffic, as indicated by directional arrows 38, and a single line of luminaires 1 placed in each row of traffic 41. FIG. 12*a* illustrates the relative ramp orientation of each scissored ramp (shown with exaggerated angles). The luminaires 1 each are depicted as a circle with an "X" to illustrate the use of the four quadrants. The shaded areas 39 within the circles indicate those quadrants that have a louver assembly installed. Note the shaded area 40 on the left of FIG. 12, which illustrates the shape of the light pattern for a single luminaire. As in FIG. 11 the shape of the pattern is narrower on the side on which a louver is installed. The configuration of luminaires shown in FIG. 12 will accomplish the objective of controlling glare in drivers eyes. With a single line of luminaires, the luminaires are generally placed so that the strong side 35 of the light pattern is perpendicular to the flow of traffic.

Figure 13:
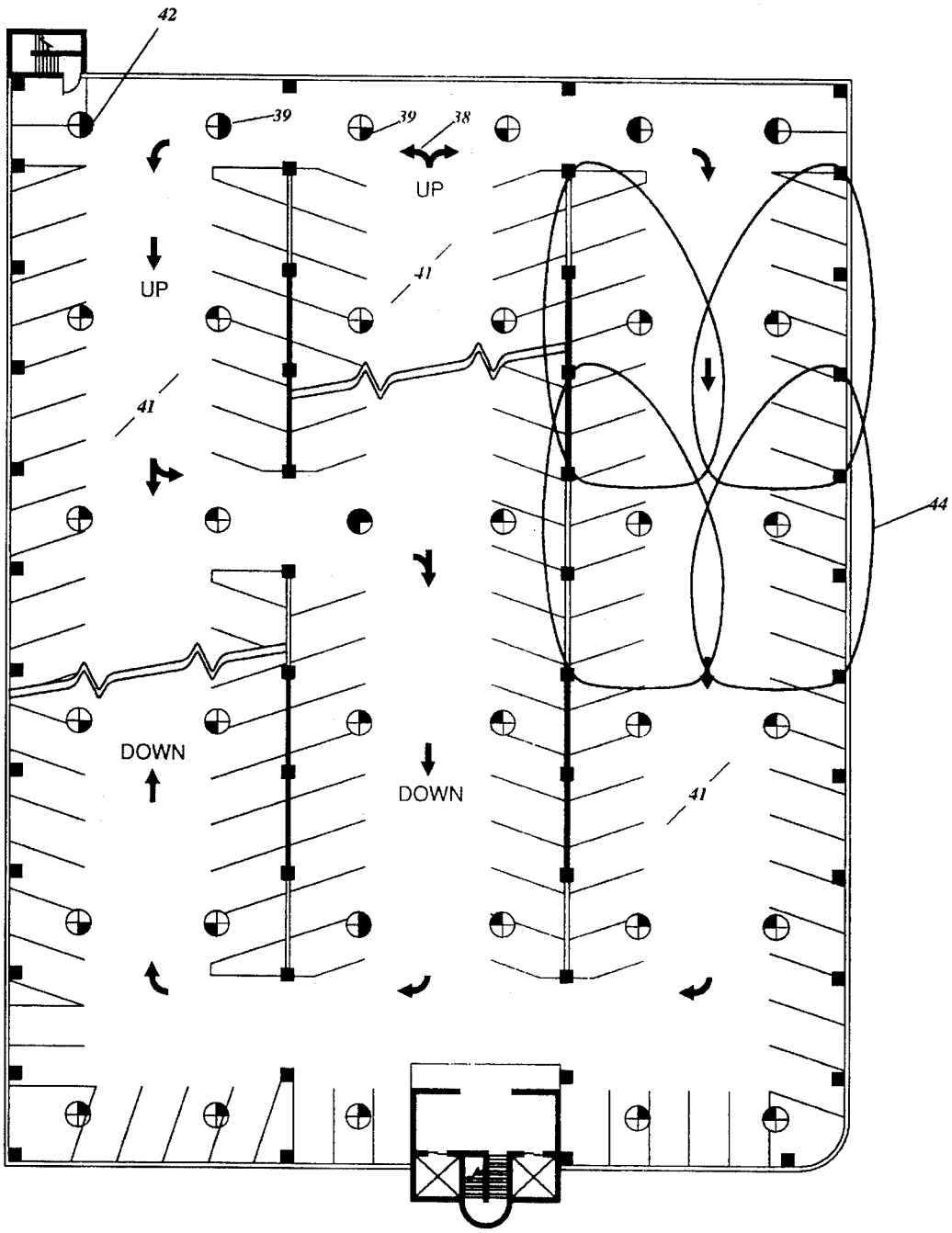
FIG. 13 is a plan view of a single floor of a typical scissored-ramp parking garage, illustrating the placement of a double row of luminaires where there is one-way traffic flow. Louvers are placed so as to control the glare in driver's eyes.

FIG. 13 illustrates the use of two rows of luminaires placed side-by-side in each traffic lane 41. As in FIG. 12, the objective of this configuration is to minimize the glare in drivers eyes. Note that the light pattern 44 is shifted 90 degrees from that of a single row configuration, thus allowing the luminaires to be placed farther apart. In general, only one corner of each luminaire requires a louver assembly to block the glare, except at the outer rows and corners, such as at 42.

Figure 14:
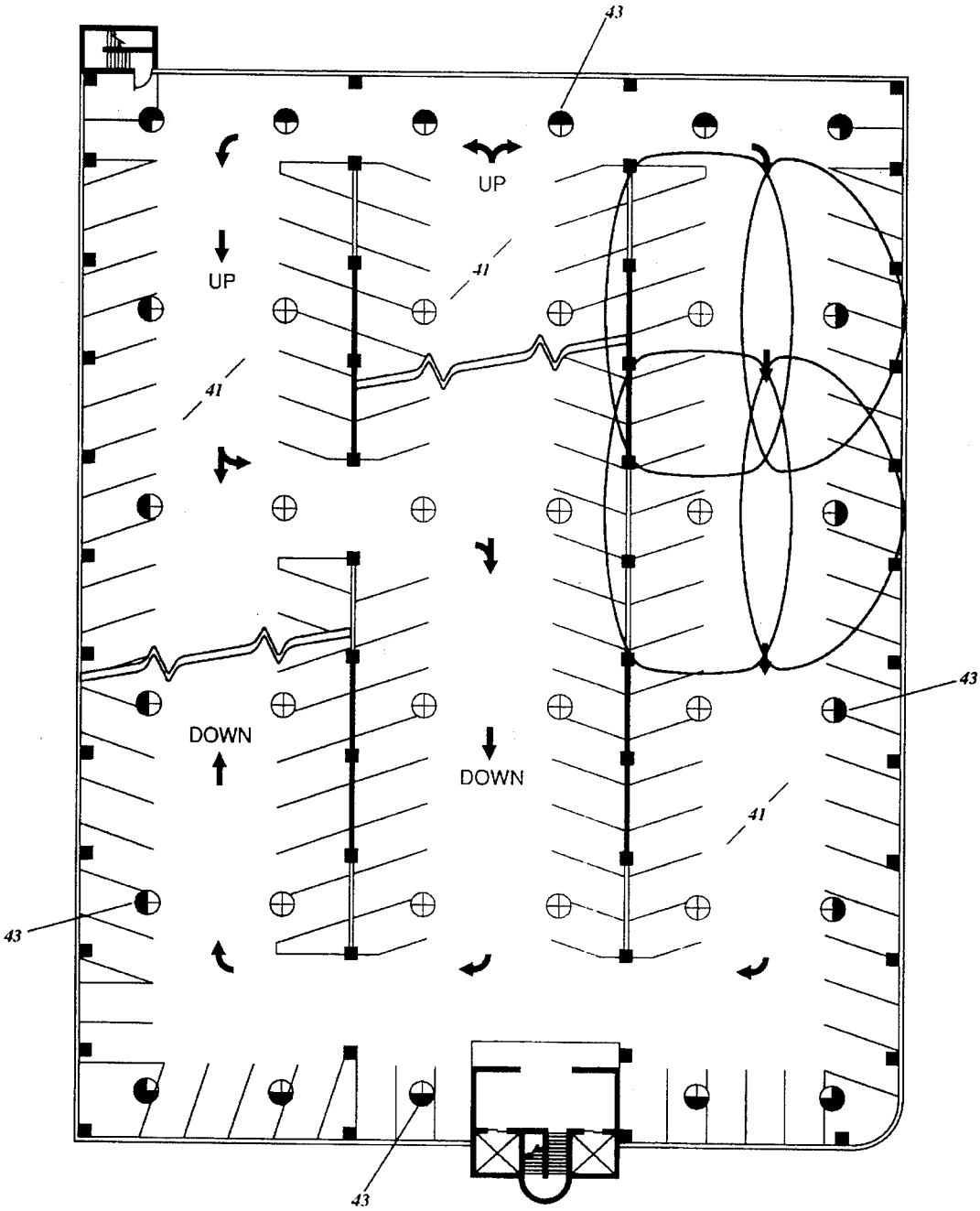
FIG. 14 is a plan view of a single floor of a typical scissored-ramp parking garage, illustrating the placement of a double row of luminaires where there is one-way traffic flow. Louvers are placed so as to control the spill light from the garage.

FIG. 14 is similar to FIG. 13 except that the louvers are placed so as to minimize the amount of spill light from the garage. Note that louver assemblies are used on the luminaires on the outer perimeter 43 of the structure.

Figure 15:
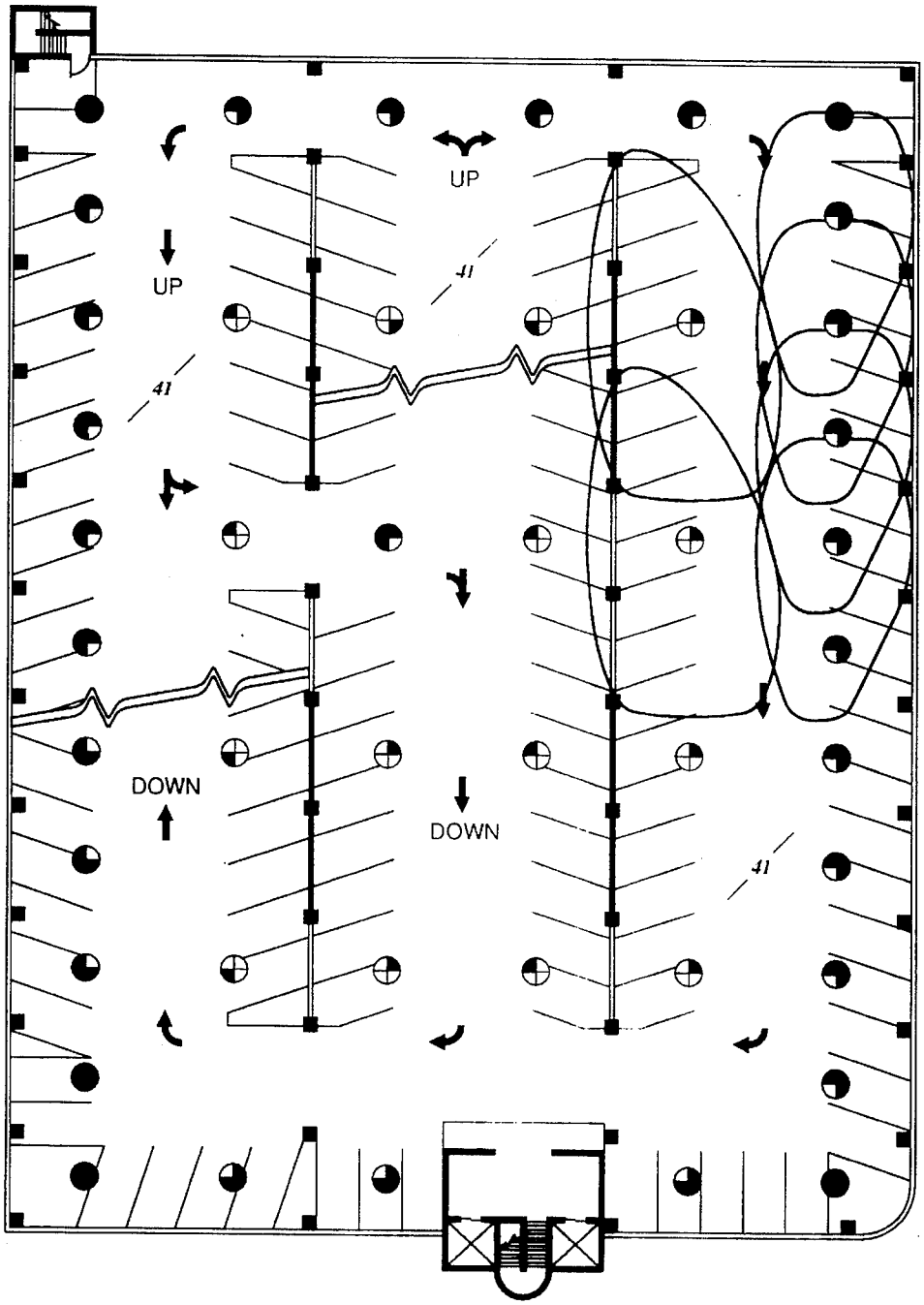
FIG. 15 is a plan view of a single floor of a typical scissored-ramp parking garage, illustrating the placement of a double row of luminaires where there is one-way traffic flow. Louvers are placed so as to control both the spill light and the glare in driver's eyes.

FIG. 15 is similar to both FIGS. 13&14 and addresses the problems of glare in the drivers eyes and light spilled into the neighborhood adjacent the parking garage. Note that the outer row of luminaires is spaced closer together because the edge of the light pattern is smaller when louvers are used on up to three and four quadrants.

A catalogue, entitled "PGL Omni-System™", showing the construction and use of the luminaire, is included as an appendix, the disclosure of which is incorporated herein.

While embodiments of the present invention have been shown and described, various modifications may be made without departing from the scope of the present invention, and all such modifications and equivalents are intended to be covered.

I claim:

1. A luminaire for lighting a parking garage, comprising a housing comprising a housing body to protect the luminaire from the elements, and a mounting cap attached to the housing body, a socket in said housing for receiving a light bulb, to provide light from said luminaire, a lens attached to said housing to refract said light in a desired vertical and horizontal pattern, a lens frame positioned around the lens and formed with a plurality of sections, whereby a louver assembly can be removably mounted in each section, and at least one louver assembly removably mounted with respect to the lens frame and disposed about at least a segment of the lens and arranged to control the vertical flow of light from the luminaire.

2. The luminaire for lighting a parking garage of claim 1 wherein said housing and said louver assembly are generally circular, and said lens is substantially in the shape of a half sphere.

3. The luminaire for lighting a parking garage of claim 1 having a lens frame that forms four quadrants around the lens, and wherein there are four of said louver assemblies that fit interchangeably into said quadrants to prevent glare and spill light.

4. The luminaire for lighting a parking garage of claim 1 wherein said louver assembly comprises a plurality of circular shaped and horizontally arranged louvers.

5. The luminaire for lighting a parking garage of claim 1 wherein there are three louvers on each louver assembly.

6. The luminaire for lighting a parking garage of claim 1 wherein each louver assembly is removably attached to said luminaire, allowing quick installation and reconfiguration of louver assemblies.

7. A luminaire kit for providing a luminaire for lighting a parking garage with selectable lighting patterns, comprising a housing comprising electrical and mechanical connections, a housing body to protect the luminaire from the elements, and a mounting cap attached to the housing body, a socket in said housing for receiving a light bulb, to provide light from said luminaire, a lens to refract light rays in a desired vertical and horizontal pattern, said lens in the shape of a half sphere, with alternating smooth and uneven surfaces, a lens frame positioned around the lens to form a plurality of sections, whereby a louver assembly can be removably mounted in each section, and whereby said lens frame frictionally holds said lens in place, and a plurality of selectable and removable louver assemblies adapted to be mounted by the lens frame and placed so as to control the vertical flow of light from said luminaire, thereby controlling glare in a driver's eyes.

8. The luminaire kit of claim 7 wherein said lens frame forms quadrants for selectably and removably mounting louver assemblies.

9. The luminaire kit of claim 7 wherein said louver assemblies each comprise three louvers.

10. A lighting system for parking garages comprising multiple luminaires wherein (a) each luminaire comprises (1) a housing comprising electrical and mechanical connections, a housing body to protect said luminaire from the elements, and a mounting cap attached to the housing body, (2) a socket in said housing for receiving a light bulb, to provide light from said luminaire, (3) a lens attached to said housing to refract said light in a desired vertical and horizontal pattern, and (4) a lens frame positioned around the lens and formed with a plurality of sections and having ribs, whereby a louver assembly can be removably mounted in each section, (b) wherein said luminaires are arranged to form one or more rows for each row of traffic, and individual ribs of the lens frame are oriented to be either parallel or perpendicular to a traffic flow direction, and (c) a plurality of louver assemblies, each removably and selectably mounted to the lens frame and arranged to control the vertical flow of light from said luminaire.

11. The lighting system for parking garages comprising multiple luminaires of claim 10 wherein the louver assemblies are generally mounted in the sections that face oncoming traffic to control glare in a driver's eyes.

12. The lighting system for parking garages comprising multiple luminaires of claim 10 wherein the louver assemblies are generally mounted in the sections that face an outer perimeter of the parking garage to control spill light into adjacent neighborhoods.

13. The lighting system for parking garages comprising multiple luminaires of claim 10 wherein the louver assemblies are generally mounted in the sections that face oncoming traffic to control glare in a driver's eyes and generally mounted in the sections that face an outer perimeter of the parking garage to control spill light into adjacent neighborhoods.

14. The lighting system for parking garages comprising multiple luminaires of claim 10 wherein the individual ribs of the lens frame are oriented to be approximately 45 degrees from the direction of traffic flow and the louver assemblies are generally mounted in the sections that face oncoming traffic to control glare in a driver's eyes.

15. The lighting system for parking garages comprising multiple luminaires of claim 10 wherein the individual ribs of the lens frame are oriented to be approximately 45 degrees from the direction of traffic flow and the louver assemblies are generally mounted in the sections that face an outer perimeter of the parking garage to control spill light into adjacent neighborhoods.

16. The lighting system for parking garages comprising multiple luminaires of claim 10 wherein the individual ribs of the lens frame are oriented to be approximately 45 degrees from the direction of traffic flow and the louver assemblies are generally mounted in the sections that face oncoming traffic to control glare in a driver's eyes and generally mounted in the sections that face an outer perimeter of the parking garage to control spill light into adjacent neighborhoods.

17. A luminaire for lighting a parking garage, comprising a housing comprising a housing body and a mounting cap attached to the housing body, a light source in said housing, a lens attached to said housing to refract light rays in a desired vertical and horizontal pattern and having a plurality of segments and adapted to receive a plurality of louver assemblies, and at least one louver assembly selectively mounted with respect to the lens, whereby each mounted louver assembly is disposed about a segment of the lens and arranged to control the vertical flow of light from the luminaire.

18. The luminaire for lighting a parking garage of claim 17 wherein each louver assembly is mounted proximate an outer perimeter of the lens.

19. The luminaire for lighting a parking garage of claim 18 further comprising a lens frame attached to the housing for selectively holding a plurality of louver assemblies.

20. A luminaire for lighting a parking garage, comprising a housing comprising a housing body and a mounting cap attached to the housing body, a light source in said housing, a lens frame attached to said housing and having a plurality of ribs forming a plurality of sections and adapted to receive a plurality of louver assemblies, and at least one louver assembly removably mounted with respect to a section of said lens frame and arranged to control vertical light flow from said luminaire.

21. The luminaire for lighting a parking garage of claim 20, further comprising a lens attached to said housing to refract light rays in a desired vertical and horizontal pattern.

22. The luminaire for lighting a parking garage of claim 21 comprising a plurality of louver assemblies and wherein each louver assembly is mounted proximate an outer perimeter of said lens.

23. A luminaire for lighting a parking garage, comprising a housing comprising a housing body and a mounting cap attached to the housing body, a light source in said housing, a lens attached to said housing to refract light rays in a desired vertical and horizontal pattern, a lens frame attached to said housing and forming a plurality of sections and adapted to receive a plurality of louver assemblies proximate said lens, said louver assemblies arranged to control the vertical flow of said light rays, whereby each louver assembly may be removably disposed about a section of said lens frame.

24. The luminaire for lighting a parking garage of claim 23 wherein each louver assembly is mounted proximate an outer perimeter of said lens.

25. A lighting system for parking garages comprising multiple luminaires wherein (a) each luminaire comprises (1) a housing comprising a housing body and a mounting cap attached to the housing body and adapted to receive a plurality of louver assemblies, (2) a light source in said housing, and (3) a lens attached to said housing to refract light rays in a desired vertical and horizontal pattern, (b) said luminaires being arranged to form at least one row for each row of traffic of the garage, and (c) at least one louver assembly removably mounted with respect to the housing, whereby each mounted louver assembly is disposed about a portion of the lens and arranged to control the vertical flow of said light rays.

26. The lighting system for parking garages comprising multiple luminaires of claim 25 wherein the louver assemblies are generally disposed about portions of the lenses that face oncoming traffic to control glare in a driver's eyes.

27. The lighting system for parking garages comprising multiple luminaires of claim 25 wherein the louver assemblies are generally disposed about portions of the lenses that face an outer perimeter of the parking garage to control spill light into adjacent neighborhoods.

28. The lighting system for parking garages comprising multiple luminaires of claim 25 wherein the louver assemblies are generally disposed about portions of the lenses that face oncoming traffic to control glare in a driver's eyes and generally disposed about the portions of the lenses that face an outer perimeter of the parking garage to control spill light into adjacent neighborhoods.

* * * * *